US007328804B2

(12) United States Patent
Andre et al.

(10) Patent No.: US 7,328,804 B2
(45) Date of Patent: Feb. 12, 2008

(54) SHIPPING SYSTEM

(75) Inventors: Joachim Andre, Püttlingen (DE); Oliver Hermes, Überherrn-Berus (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 502 days.

(21) Appl. No.: 11/002,495

(22) Filed: Dec. 2, 2004

(65) Prior Publication Data

US 2005/0121358 A1 Jun. 9, 2005

(30) Foreign Application Priority Data

Dec. 5, 2003 (DE) ..... 103 57 278

(51) Int. Cl.
*B65D 19/00* (2006.01)

(52) U.S. Cl. ..... 206/600; 206/386; 206/443

(58) Field of Classification Search ..... 206/391, 206/386, 443, 600; 220/6, 7, 4.28, 4.33
See application file for complete search history.

(56) References Cited

U.S. PATENT DOCUMENTS 2,990,951 A * 7/1961 Fallert ..... 206/597
4,195,732 A * 4/1980 Bell ..... 206/391
4,832,196 A * 5/1989 Butler ..... 206/391
4,901,870 A * 2/1990 Wright et al. ..... 211/59.4
5,228,821 A * 7/1993 Gleffe et al. ..... 414/403
5,253,763 A * 10/1993 Kirkley et al. ..... 206/600
5,415,311 A * 5/1995 Coogan ..... 220/6
5,609,111 A * 3/1997 Hasegawa et al. ..... 108/55.1
6,098,803 A * 8/2000 Tanaka et al. ..... 206/443
6,119,861 A * 9/2000 Schneider ..... 206/443
6,691,885 B2 * 2/2004 Brown ..... 220/7
6,820,761 B1 * 11/2004 Mouri et al. ..... 220/6
6,843,386 B2 * 1/2005 Raghunathan et al. ..... 220/7
6,874,637 B2 * 4/2005 Pigott et al. ..... 206/600

FOREIGN PATENT DOCUMENTS

DE 1 956 291 2/1967
DE 41 28 770 A1 4/1992
DE 203 00 125 U1 7/2003

* cited by examiner

*Primary Examiner*—David T. Fidei
(74) *Attorney, Agent, or Firm*—Collard & Roe, P.C.

(57) ABSTRACT

The present invention relates to a shipping system (1) for shipping articles, comprising a shipping box (2) which can be converted between an in-use state in which it can be loaded with articles and a not-in-use state in which it has a reduced height in comparison with the in-use state while having the same base area, and comprising multiple positioning elements that are stackable one above the other, each having at least one holding fixture arranged side-by-side to hold a section of one of the articles. The shipping box (2) is designed to accommodate at least one stack of positioning elements in the in-use state and in the not-in-use state it is designed to accommodate the positioning elements.

15 Claims, 4 Drawing Sheets

SHIPPING SYSTEM

CROSS REFERENCE TO RELATED APPLICATIONS

Applicants claim priority under 35 U.S.C. §119 of German Application No. 103 57 278.3 filed Dec. 5, 2003.

BACKGROUND OF THE INVENTION

1. Field of the Invention

The present invention relates to a shipping system for shipping articles.

2. The Prior Art

It is generally known that shipping boxes having a shipping volume in which the articles to be shipped can be accommodated may be used for shipping various articles.

These shipping boxes are relatively easy to handle, e.g., by means of a forklift. These shipping boxes facilitate loading and unloading of a truck, for example, which greatly simplifies shipping of articles over great distances.

An important shipping problem may occur with articles which form units that can be manufactured by preassembly then incorporated into the respective end product as part of a final assembly. In many cases, there is a great distance between the location of preassembly and the location of final assembly, so the completely preassembled units or intermediate products must be shipped from one location to another, frequently over great distances. Shipping becomes especially problematical in cases when the articles shipped are sensitive to impact because of their size and/or properties so that shipping entails the risk of damage to the articles. Depending on the extent and frequency of such damage, the manufacturer of the articles may decide whether to leave the production of the articles at the original preassembly site or whether to shift it to the site of final assembly for economic reasons. Therefore, based on economic considerations, the shipping problem may decide whether manufacturing sites are to be retained or must be moved. However, moving a manufacturing site is associated with enormous expense and complexity. Another economic and logistic problem may also occur due to the fact that the shipping boxes are usually empty during the return shipping from the site of final assembly to the site of preassembly, but this does not contribute to the profitability of shipping operations.

SUMMARY OF THE INVENTION

The present invention is concerned with the problem of providing an improved embodiment of such a shipping system of the type defined in the preamble which will make it possible in particular to ship items that are sensitive to impact in a protected and economically advantageous manner.

This problem is solved according to this invention by the object of the independent claim. Advantageous embodiments are the object of the dependent claims.

This invention is based on the general idea of using a shipping box for shipping the various articles, said box being convertible between an in-use state with a large loading volume and a not-in-use state with a small loading volume. The shipping system here consists of positioning elements which are adapted to the articles to be shipped and which are stackable in a large loading volume in the in-use state of the shipping box. It is of crucial importance here that the positioning elements can be accommodated in a small loading volume when the shipping box is in a not-in-use state. The inventive shipping system offers many advantages. First, it allows fixation of the position within the shipping box for the articles; this prevents and/or greatly reduces relative movement between the individual articles during shipping and thereby greatly reduces the risk of damage to the articles. Secondly, the shipping boxes in their not-in-use state have a greatly reduced volume, so they can be shipped inexpensively in the not-in-use state. It is significant here that the positioning elements allocated to the particular shipping box can then be accommodated completely in the respective shipping box even if they are in their not-in-use state.

The inventive shipping system therefore makes it possible to return the shipping boxes together with the positioning elements inexpensively from a second location to the first location after shipping the articles from a first location to a second location.

Holding fixtures arranged side-by-side are provided in the positioning elements so that a section of one of the articles can be inserted into them. This yields a means of form-fitting positioning and holding of the respective article by means of the respective positioning element in the shipping box. An embodiment of particular importance is one in which the positioning elements are designed and can be stacked one above the other so that in a stack at least one holding fixture that is open toward the top of a lower positioning element is aligned with a holding fixture that is open toward the bottom and is provided in an upper positioning element such that the holding fixtures that are aligned with one another serve to hold the same article from above and beneath. This yields a particularly reliable means of holding and positioning the particular articles.

According to a refinement of the embodiment, the holding fixtures of the positioning elements are shaped for holding sections of at least two different articles and/or holding at least two different sections of the same articles. Due to this design, the positioning elements can be positioned at different locations within the shipping box to support the respective article, which thus makes it possible to use positioning elements having the same design. Additionally or alternatively, it is possible through this design to reliably ship different articles using the same positioning elements in the shipping box with the same positioning of the shipping elements inside the shipping box. The articles may be exhaust gas lines for motor vehicles, for example, in particular for passenger vehicles. Due to the proposed embodiment of the positioning elements, at least two different types of exhaust gas lines may thus be accommodated in the shipping box in a secure manner using the same positioning elements. This measure thus increases the flexibility and profitability of the shipping system.

Other important features and advantages of this invention are derived from the subclaims, the drawings and the respective description of the figures on the basis of the drawings.

It is self-evident that the features mentioned above and those to be explained below can be used not only in the particular combination given but also in other combinations or even alone without going beyond the scope of the present invention.

BRIEF DESCRIPTION OF THE DRAWINGS

The preferred exemplary embodiment of this invention is illustrated in the drawings and is explained in greater detail in the following description, where the same reference notation is used to refer to the same or functionally same or similar components.

The figures show schematically.

DETAILED DESCRIPTION OF PREFERRED EMBODIMENTS

Figure 1:
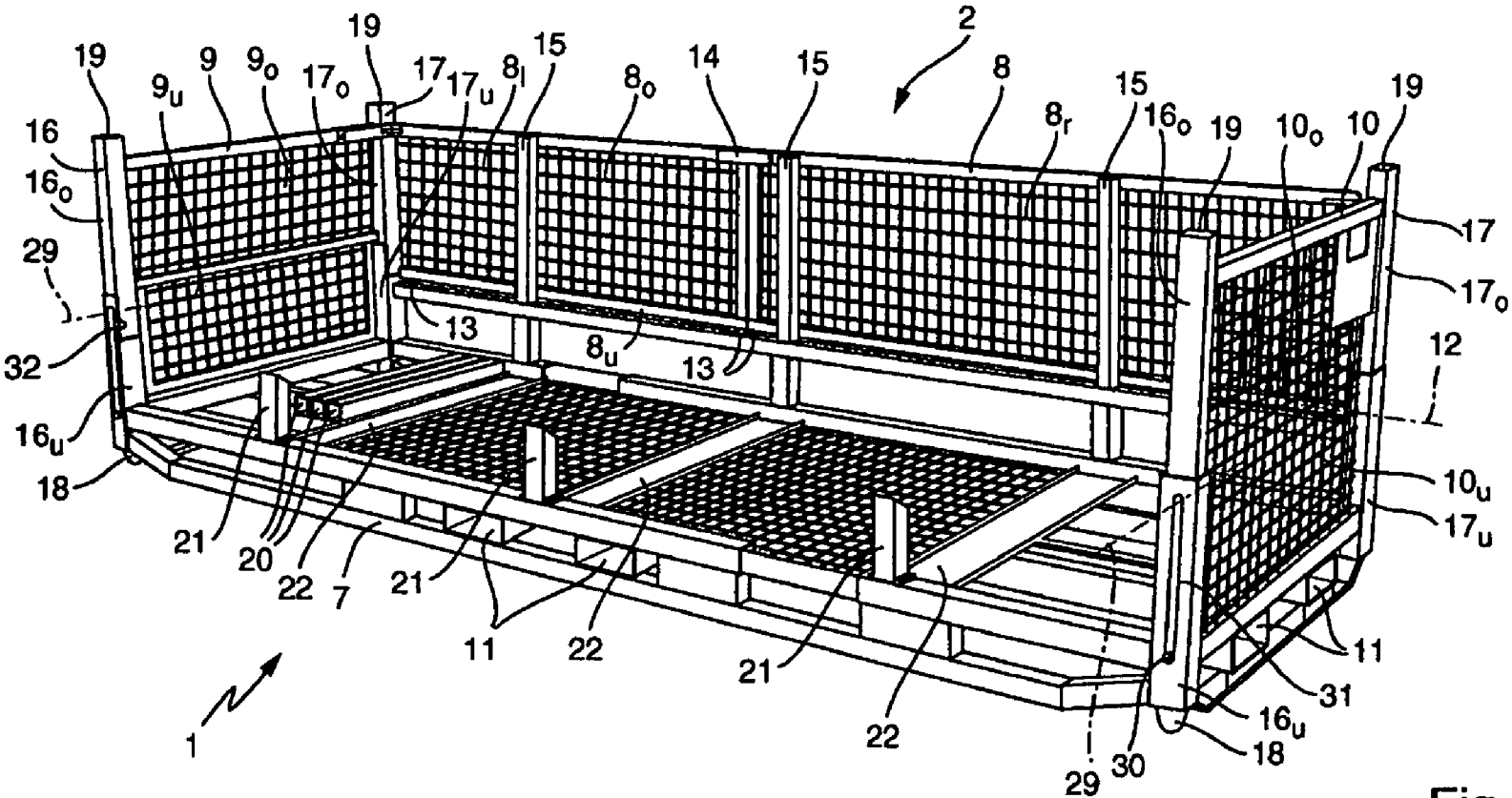
FIG. 1 a perspective view of a shipping box according to this invention.
Figure 2:
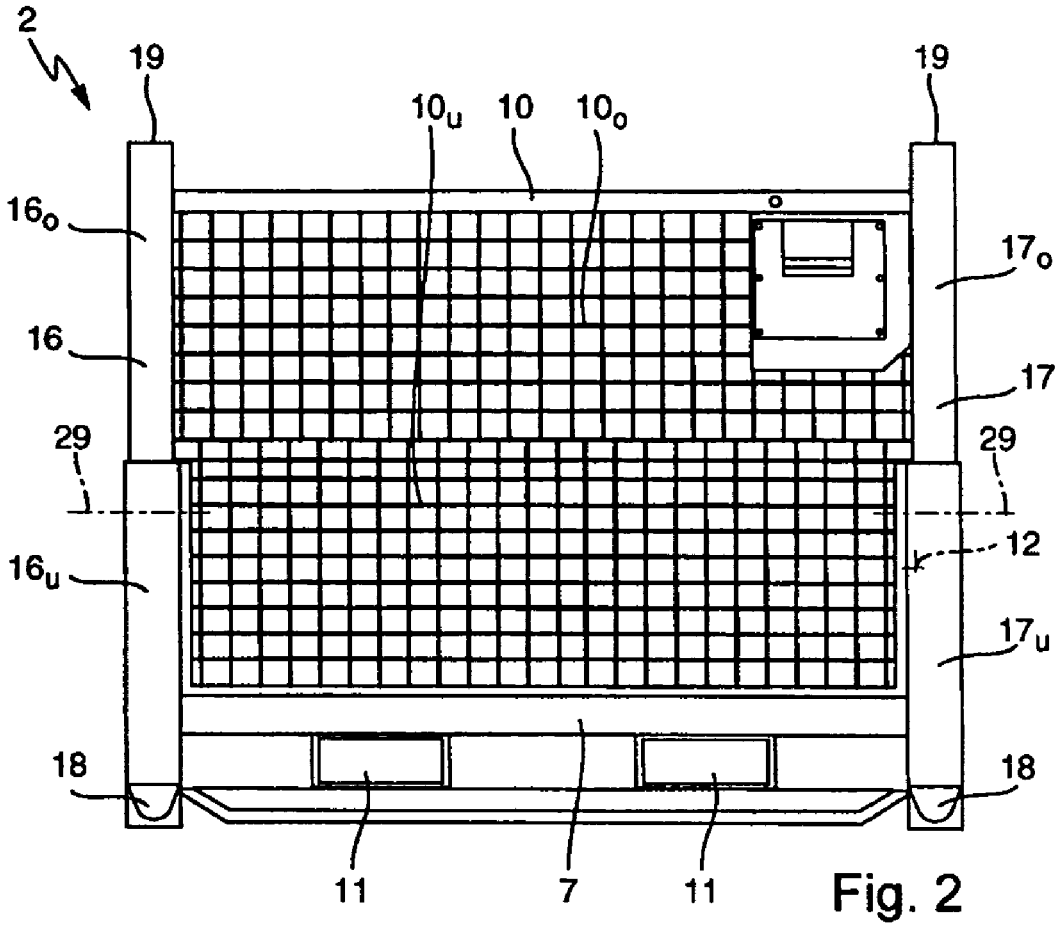
FIG. 2 a side view of the shipping box in its in-use state.
Figure 3:
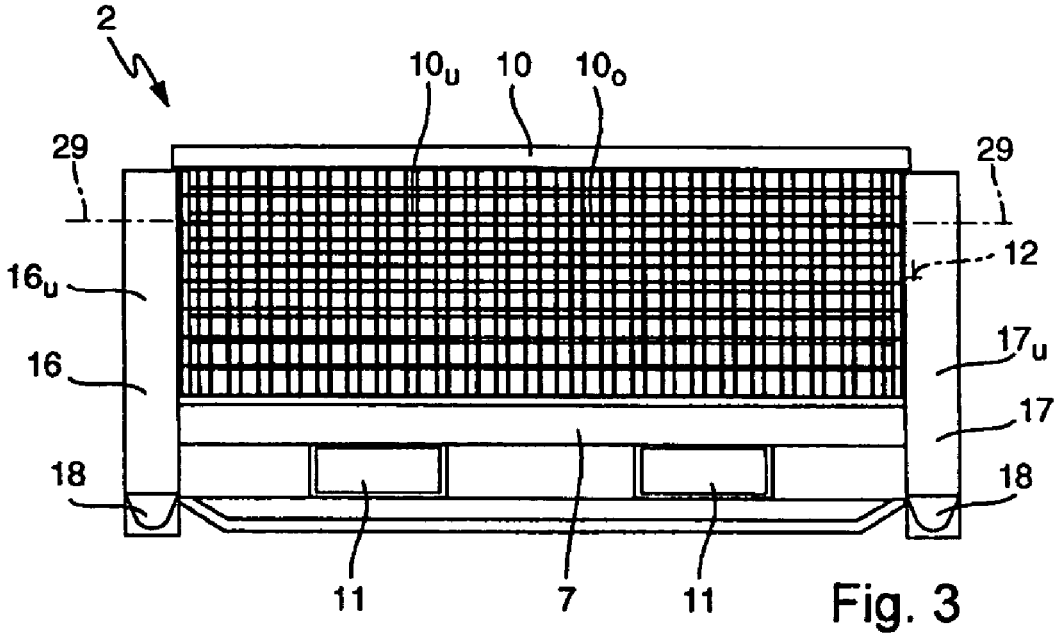
FIG. 3 a side view like that in FIG. 2 but in the not-in-use state of the shipping box, FIGS. 4-7 perspective views each showing a positioning element in different embodiments, FIG. 8 a side view of positioning elements stacked one above the other, FIG. 9 a view like that in FIG. 8 but of a different stack.
Figure 4:
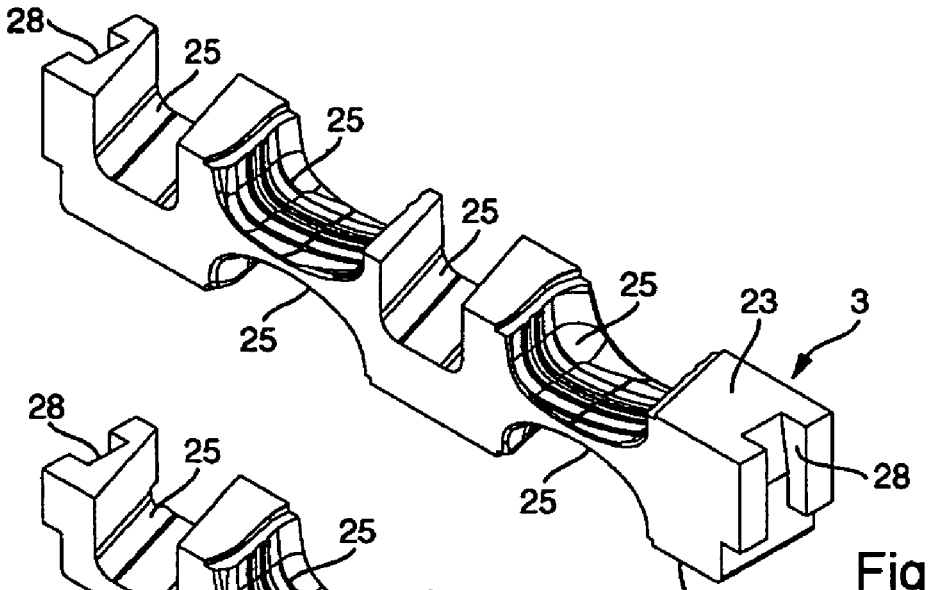
Figure 5:
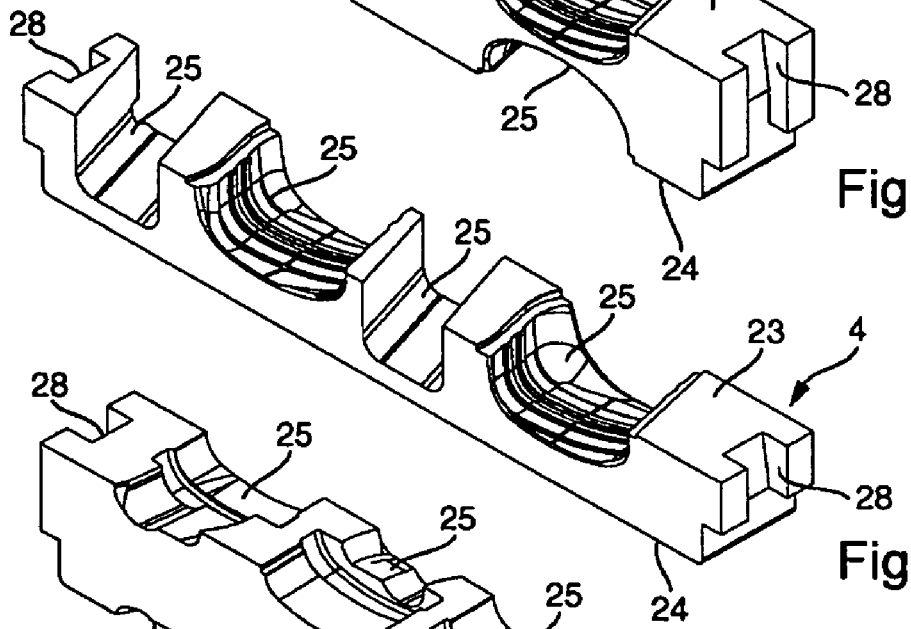
Figure 6:
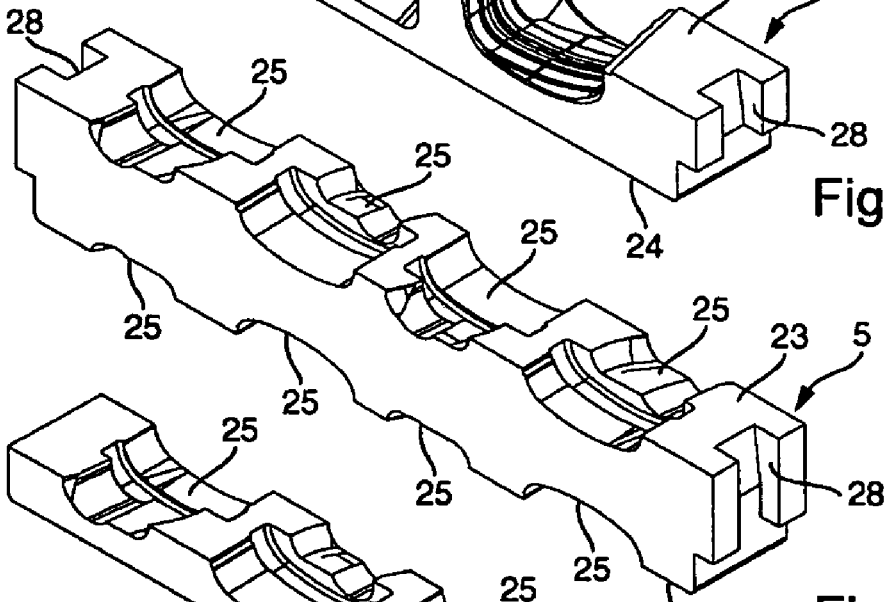
Figure 7:
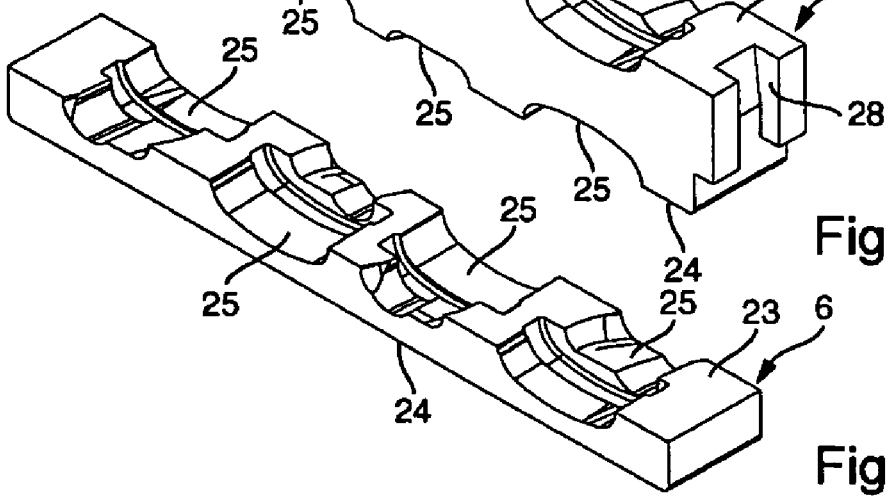

According to FIGS. 1 through 3, an inventive shipping system 1 comprises a shipping box 2 and positioning elements 3, 4, 5, 6 illustrated in FIGS. 4 through 9.

According to FIG. 1, the shipping box 2 has a bottom 7, a rear wall 8 and two side walls 9, 10. The bottom 7 preferably has a stable steel frame construction and has a holding shoe 11 for the fork of a forklift on its front side. In addition, the embodiment of the shipping box 2 shown here is also equipped with holding shoes 11 for the fork of a forklift on its right and left sides. This simplifies handling of the shipping box 2 by means of a conventional forklift. The holding shoes 11 have a closed profile, so that the shipping box 2 and the articles accommodated in it are protected from damage due to the forks of the forklift. In addition, the holding shoes 11 are integrated into the bottom 7, which reduces the total height of the shipping box 2.

The rear wall 8 is mounted so that it is adjustable by pivoting about a pivot axis 12 running parallel to the bottom 7 and parallel to the rear side of the shipping box 2 in the area of its lower third. The rear wall 8 is rotationally pivotable approximately 90° forward from the position illustrated here into a horizontal position. To do so, an upper pivotable section $\mathbf{8}_o$ is mounted by bearings 13 so that it is adjustable by pivoting on a lower section $\mathbf{8}_u$ of the rear wall 8. The lower rear wall section $\mathbf{8}_u$ is mounted on the bottom 7 in a fixed position.

In the preferred embodiment illustrated here, the rear wall 8 is designed in two parts and thus has a left section $\mathbf{8}_l$ and a right section $\mathbf{8}_r$ which can be pivoted independently about the pivot axis 12. The divided rear wall 8 simplifies handling of the rear wall 8 for pivoting because each individual rear wall element $\mathbf{8}_l$, $\mathbf{8}_r$ has a reduced weight and is thus comparatively easy to handle. The rear wall elements $\mathbf{8}_l$, $\mathbf{8}_r$ can be secured against one another by means of a coupling element 14, which increases the stability of the multipart rear wall 8 in particular for the upright position according to FIG. 1.

Rear guide rods 15 are provided on the rear wall 8. These guide rods 15 protrude into the loading space of the shipping box 2 on one side of the rear wall 8 which faces the front side of the shipping box 2. In addition, the rear guide rods 15 run essentially vertically with an upright rear wall 8. The rear guide rods also have an upper section (not shown in detail here) which is designed on the pivotable upper rear wall section $\mathbf{8}_o$. Accordingly, lower sections (not shown in greater detail) of the rear guide rods 15 are each part of the stationary lower rear wall section $\mathbf{8}_u$.

The side walls 9, 10 each have two corner posts 16, 17 which are arranged in the corners of the bottom 7. An upper side wall section $\mathbf{9}_o$, $\mathbf{10}_o$ and a lower side wall section $\mathbf{9}_u$ and/or $\mathbf{10}^u$ extend(s) between the corner posts 16, 17. Thus the side walls 9, 10 are also divided, but in contrast with the rear wall 8, they are not divided vertically but instead are divided horizontally.

One particular feature is that the side walls 9, 10 are adjustable in a translational adjustment but also in a state in which they are pulled upward in the upper direction they are designed to be adjustable by pivoting about a pivot access 29 running parallel to the bottom 7 and parallel to the particular side wall 9, 10.

Translational adjustability is achieved here, for example, by designing the corner posts 16, 17 to be telescoping. To this end, each corner post 16, 17 has a lower section $\mathbf{16}_u$ and/or $\mathbf{17}_u$ which is fixedly mounted on the bottom 7, as well as an upper section $\mathbf{16}_o$ and/or $\mathbf{17}_o$ which is mounted so that it is vertically adjustable on the particular lower post section $\mathbf{16}_u$, $\mathbf{17}_u$. This translational movement of the individual upper post sections $\mathbf{16}_o$ is guided by a bolt 30 that protrudes laterally on the upper post section $\mathbf{16}_o$ and engages in an elongated hole 31 there (see FIG. 1). This elongated hole is designed in the lower respective post section $\mathbf{16}_u$, $\mathbf{17}_u$ and extends vertically. In the state in which it is pulled out and upward, the respective bolt 30 then defines the pivot axis 29 and permits a pivoting adjustment of the respective upper post section $\mathbf{16}_o$, $\mathbf{17}_o$ out of the upright position shown here and into a position in which it is pivoted inward by approximately 90°. To achieve pivotability of the particular upper post section $\mathbf{16}_o$, $\mathbf{17}_o$, an opening 32 is recessed on the respective lower post section $\mathbf{16}_u$, $\mathbf{17}_u$ on the upper end on the inside facing the loading space of the shipping box 2. The upper post section $\mathbf{16}_o$, $\mathbf{17}_o$ can be pivoted inward about the respective pivot axis 29 through this opening 32. In the in-use state of the shipping box 2, the upper post sections $\mathbf{16}_o$, $\mathbf{17}_o$ according to FIG. 1 are retracted into the respective lower post sections $\mathbf{16}_u$, $\mathbf{17}_u$. In this retracted state, the upper post section $\mathbf{16}_o$, $\mathbf{17}_o$ are completely encompassed at the lower end by the closed profile of the lower post sections $\mathbf{16}_u$, $\mathbf{17}_u$ and thus they are secured in a form-fitting manner in their upright position.

The upper wall section $\mathbf{9}_o$, $\mathbf{10}_o$ extending between the upper post sections $\mathbf{16}_o$, $\mathbf{17}_o$ may be fixedly connected to the upper posts sections $\mathbf{16}_o$, $\mathbf{17}_o$ and may also follow the translational and rotational adjusting movement of the upper post sections $\mathbf{16}_o$, $\mathbf{17}_o$ in a corresponding manner so that on each side of the shipping box 2, the two upper post sections $\mathbf{16}_o$, $\mathbf{17}_o$ together with the upper wall section $\mathbf{9}_o$ and/or $\mathbf{10}_o$ arranged between them may constitute a jointly adjustable unit. As an alternative it is essentially also possible to detachably mount, e.g., by hook arrangement of the upper wall section $\mathbf{9}_o$, $\mathbf{10}_o$ which extends between the upper post sections $\mathbf{16}_o$, $\mathbf{17}_o$ on the respective upper post sections $\mathbf{16}_o$, $\mathbf{17}_o$. The respective upper wall section $\mathbf{9}_o$, $\mathbf{10}_o$ may be adjusted inward or outward in a translational movement in front of the respective lower side wall section $\mathbf{9}_u$, $\mathbf{10}_u$ independently of the upper post sections $\mathbf{16}_o$, $\mathbf{17}_o$.

In this lowered state, the upper side wall section $\mathbf{9}_o$, $\mathbf{10}_o$ may be secured, e.g., hooked on the lower side wall section $\mathbf{9}_u$, $\mathbf{10}_u$, for example.

FIGS. 1 and 2 show a state in which the right side wall 10 has its greatest height. The corner posts 16 and 17 are uprighted here and are secured in this position. The upper side wall section $\mathbf{10}_o$ is secured on the upper post sections $\mathbf{16}_o$, $\mathbf{17}_o$.

In contrast with that, FIG. 3 shows the right side wall 10 with its minimally adjustable height, i.e., when the upper corner post sections $\mathbf{16}_o$, $\mathbf{17}_o$ are pivoted inward and the upper wall section $\mathbf{10}_o$ is shifted downward, for example, in front of or behind the lower wall section $\mathbf{10}_u$. The height of the side wall 10 can be adjusted in this way. In particular the height of the side wall 10 in the extracted state according to FIG. 2 is approximately twice as great as that in the retracted state according to FIG. 3.

The inventive shipping box 2 can thus be converted between an in-use state as illustrated in FIGS. 1 and 2 and a not-in-use state as indicated in FIG. 3. In the in-use state, the rear wall 8 is pivoted into its upright position. In addition, in the in-use state, the side walls 9, 10 are also uprighted. The shipping box 2 in its in-use state thus has a relatively large loading volume. In the not-in-use state, the side walls 9, 10 and the rear wall 8 are each pivoted inward into their horizontal position according to FIG. 3. Consequently, the loading volume of the shipping box is greatly reduced in its not-in-use state. However, it is especially important that the height of the shipping box 2 changes when it is converted from the in-use state to the not-in-use state, but its base area does not vary. An embodiment in which the height of the shipping box 2 in the not-in-use state is only approximately half as great as in the in-use state is preferred. As a result of this design, two shipping boxes 2 when stacked together in their not-in-use state take up the same amount of space as a shipping box 2 in the in-use state. For example, twice as many empty shipping boxes 2 can be shipped back in an empty truck than full shipping boxes in the forward direction.

The shipping box 2 is preferably designed to be stackable.

To do so, its corner posts 16, 17 are designed with tapering sections on their lower ends 8 and they are open at their upper ends 19. In this way, the tapering sections 18 of one shipping box 2 can be inserted into the open ends 19 of another shipping box 2. Through suitable dimensioning of the shipping boxes 2, essentially the same height can be achieved for the shipping boxes stacked one above the other as that of a single shipping box 2 in its in-use state.

This greatly simplifies the logistics in return shipping of empty shipping boxes 2.

It is particularly important here that the shipping box 2 can be stacked in its in-use state and also in its not-in-use state. The lower post sections $\mathbf{16}_u$, $\mathbf{17}_u$ are thus designed to be open at their upper ends when the upper post sections $\mathbf{16}_o$, $\mathbf{17}_o$ are folded open.

The shipping box 2 is also equipped with front guide rods 20 which can be placed loosely on the bottom 7 of the shipping box 2 according to FIG. 1. For fixation of the front guide rods 20 on the bottom 7, a rod holding fixture 21 provided for each guide rod 20 is attached to the bottom 7 at the front side. The rod holding fixture 21 is expediently a pipe section which is open at the top and into which the particular front guide rod 20 can be inserted. When the front guide rods 20 have been inserted into their rod holding fixtures 21, they extend vertically and aligned with the rear guide rods 15 in a direction of sight from forward to the rear. In addition, a guide rail 22 extending from the front side to the rear side of the bottom 7 is mounted on the bottom 7 between a rear guide rod 15 and a front guide rod 20 and/or its rod holding fixture 21.

With reference to FIGS. 4 through 9, each positioning element 3 through 6 is equipped with at least two holding fixtures 25 arranged side-by-side on at least one side (top side 23 or bottom side 24). These holders 25 are shaped so that they are capable of holding a section of an article to be shipped with the help of the shipping box 2. These articles are elongated items which are supported in the holding fixtures 25 for shipping purposes. The articles are supported, i.e., secured only in sections or partially with respect to their length. For example, the articles may be the exhaust lines of motor vehicles, in particular passenger vehicles. Such an exhaust line comprises pipe elements and at least one muffler and in particular a particle filter and/or a catalytic converter.

According to a preferred embodiment, the holding fixtures 25 provided in the positioning elements 3 through 6 are shaped so that they can be used to accommodate various sections of the respective article. It is possible in this way to vary the position of the respective positioning elements 3 through 6 within the shipping box 2 in a predetermined manner and/or in the case of a fixed position of the positioning elements 3 through 6 to insert the respective article into the holding fixtures 25 in various predetermined ways. For example, the articles may even be accommodated so that they are laterally inverted or turned away from the holding fixtures due to this design. This increases the flexibility of the shipping system 1.

Additionally or alternatively, the holding fixtures 25 may also be shaped so that they can also be used to support different articles. This also increases the flexibility of the shipping system 1 because in this way different types of articles, in particular the exhaust lines of different types of vehicles, can be shipped with the same shipping box 2 in combination with the same positioning elements 3 through 6.

Figure 8:
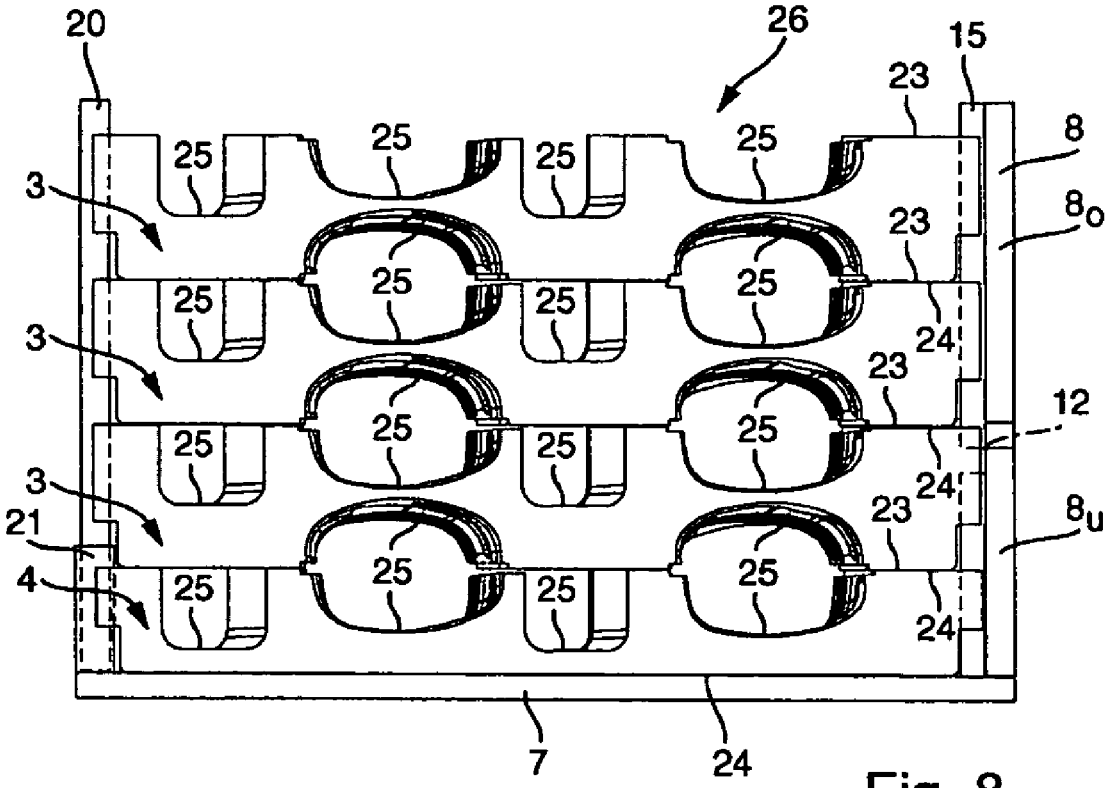
Figure 9:
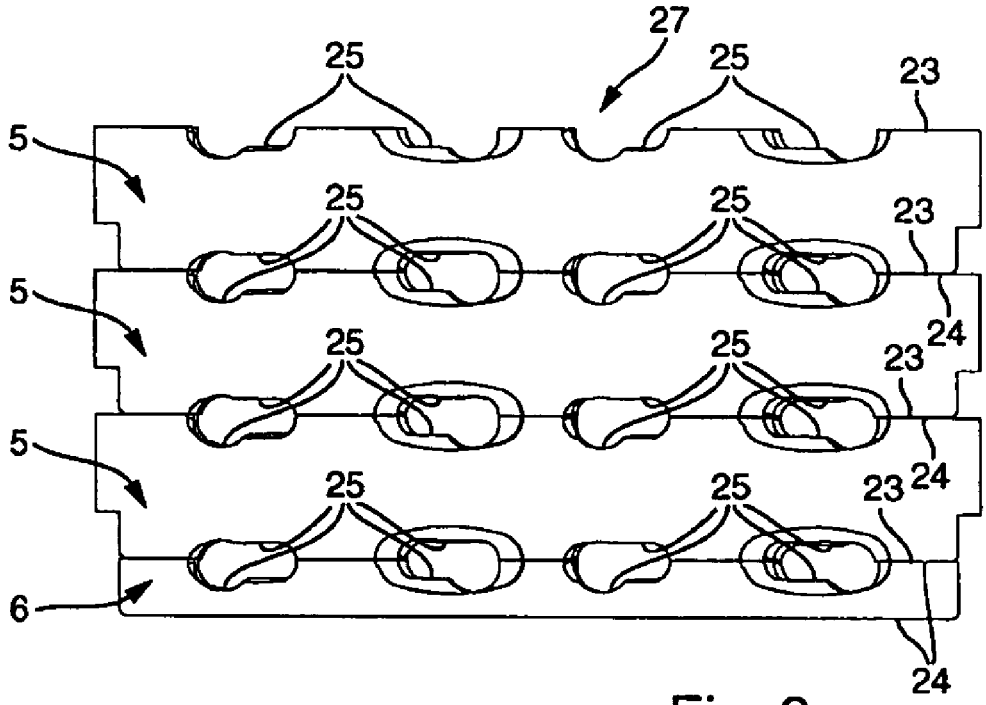

According to FIGS. 8 and 9, the positioning elements 3 through 6 are designed so that they can be stacked one above the other. FIG. 8 shows a stack 26 which is composed of the positioning elements labeled as 3 and 4, while FIG. 9 shows a stack 27 which is composed of the positioning elements labeled as 5 and 6. Each stack 26, 27 here consists of four positioning elements 3 through 6, but of course there may also be more or fewer positioning elements 3 through 6 per stack 26, 27.

As shown in FIGS. 8 and 9, at least a few of the holding fixtures 25 are arranged on the positioning elements 3 through 6 in such a way that when the positioning elements 3 through 6 are stacked one above the other, this yields an arrangement in which a holding fixture which is open at the top and is part of a lower positioning element 3 through 6 is aligned with a holding fixture 25 which is open at the top and is part of an upper positioning element 3 and 5.

In this way, the holding fixtures 25 which are aligned with one another can serve to hold the same article in the area of the same longitudinal section, namely from above and below. In the embodiments shown here, the positioning elements 3 through 6 stacked one above the other are in contact with one another on their top sides 23 and bottom sides 24, so that the aligned holding fixtures 25 completely encompass the respective article in the circumferential direction. Second, the holding fixtures 25 which are open at the top and are not paired with any corresponding holding fixture 25 in the respective upper positioning element 3, 5, are closed by the respective underside 24 of the respective upper positioning element 3, 5, so that here again the articles accommodated therein are enclosed in the circumference. This results in a particularly reliable positioning and holding means for the objects held in this way.

The positioning elements 3 and 4 of the stack 26 according to FIG. 8 differ from the positioning elements 5 and 6 of the stack 27 according to FIG. 9 in particular due to the fact that their holding fixtures are adapted for different sections of the respective article that are different distances apart. Accordingly, these stacks 26, 27 are arranged in different positions inside of the shipping box 2. For elongated articles, the inventive shipping system 1 includes at least two stacks 26, 27 of positioning elements 3 through 6 within each shipping box 2. In the preferred embodiment illustrated here, a total of three stacks 26, 27 are provided, namely a middle stack 27 according to FIG. 9 and two side stacks 26 according to FIG. 8. The stacks 26, 27 are arranged within the shipping box 2 in the area of the guide rods 15, 20 and the guide rail 22.

At least some of the positioning elements 3 through 6, i.e., here the positioning elements labeled as 3, 4, 5, are equipped on their longitudinal ends with guide holding fixtures 28 which are aligned vertically with one another when the positioning elements 3 through 6 are stack one above the other. To create the stack 26, 27, first the bottom positioning element 4, 6 is inserted into the respective guide rail 22. The bottom positioning elements 4, 6 are expediently designed to be flat on their respective bottom side 24 so that they do not have any holding fixtures on their bottom side 24. Consequently, the bottom positioning elements 4, 6 have only holding fixtures 25 that are open at the top. This results on the whole in improved utilization of freight capacity because the bottom positioning elements 4, 6 each have a much smaller height according to FIGS. 8 and 9 than the respective upper positioning elements 3, 5.

The guide rails 22 have lateral edges which protrude upward and at the sides enclose the bottom positioning elements 4, 6 inserted in each place, thereby securing them in the longitudinal direction of the shipping box 2. At the same time, the guide rods 15, 20 engage in the respective guide holding fixtures 28, which also contributes toward a form-fitting positioning of the respective bottom positioning element 4, 6 on the shipping box 2.

After inserting the bottom positioning elements 4, 6 place, the articles intended for shipping may be inserted into the shipping box 2 in a first position. In doing so, each object is inserted into a holding fixture 25 of the three stacks 26, 27 and supported along its length at three different sections that are spaced a distance apart.

Expediently, the articles that are adjacent in the transverse direction are each inserted with a turn in their position to achieve a higher packing density. After loading the holding fixtures 25 of the bottom positioning elements 4, 6, the first upper positioning elements 3, 5 may be placed in position. These positioning elements 3, 5 are also secured in a form-fitting manner on the shipping box 2 by the guide rods 15, 20 that engage in the guide holding fixtures 28. Then the next layer of articles may be loaded.

This procedure is repeated until the top positioning elements 3, 5 have been loaded. At the end, the variant shown here is loaded with four layers of four items each, i.e., with a total of 16 items, each being supported partially in three locations with respect to their length.

The inventive shipping system 1 thus allows loading of the shipping box 2 with a comparatively high loading density, whereby at the same time the positioning elements 3 through 6 ensure that the articles are secured in position in relation to one another and in relation to the shipping box 2 and in particular they cannot come in contact with one another. Vibration that occurs during shipping therefore usually cannot result in mutual contact among the items or between the items and the shipping box 2 so that the risk of damage to the articles due to shipping is reduced.

However, an essential feature of the present invention is also the fact that after unloading the shipping box 2, the respective positioning elements 3 through 6 can be accommodated in the shipping box 2 even then and can be carried in it when the box is in its not-in-use state. For example, the individual positioning elements 3 through 6 may therefore be placed side-by-side on the bottom 7. Then the rear wall 8 and the side walls 9, 10 can each be pivoted into their horizontal positions, in which they extend above the positioning elements 3 through 6. At the same time, the front guide rods 20 can also be removed from the respective rod holding fixtures 21 and also placed on the bottom 7. Thus all the components of the shipping system 1 are always side-by-side, which greatly simplifies handling of the shipping system 1.

Another important point is also regarded as being the fact that apart from the bottom positioning element 4, 6, all the other positioning elements 3, 5 are of the same design within a respective stack 26, 27. In addition, for the embodiment which works with three stacks 26, 27, a variant in which the upper positioning elements 3 of the two side stacks 26 are of the same design is also preferred. For different positioning on the left or right, the holding fixtures 25 are designed and/or arranged symmetrically accordingly. In this embodiment, the bottom positioning elements 4 of the two side stacks 26 are also designed to be identical in a corresponding manner. Since identical parts can be manufactured in large numbers, this reduces the individual price in an advantageous manner.

A variant of the positioning elements 3 through 6 in which the positioning elements 3 through 6 are made of a plastic is preferred. With an appropriate choice of material, it is thus possible to ensure that the articles accommodated in the shipping box 2 may are held and/or positioned with cushioning, which additionally reduces the risk of damage to the articles due to vibration and impacts during shipping. As an alternative, the positioning elements 3 through 6 may also be made of a material that is especially suitable for gentle support only in the area of their holding fixtures 25. For example, the positioning elements 3 through 6 may be lined with foam in the area of their holding fixtures.

The invention claimed is:

1. A shipping system for shipping articles having a shipping box (2) which can be converted between an in-use state in which the shipping box (2) can be loaded with articles and a not-in-use state in which the shipping box (2) has a reduced height in comparison with the in-use state while still having the same base area, having multiple positioning elements (3, 4, 5, 6), each having at least two holding fixtures (25) arranged side-by-side, each being shaped to hold a section of one of the articles, wherein the positioning elements (3, 4, 5, 6) can be stacked one above the other, wherein the shipping box (2) is designed to accommodate at least one stack (26, 27) of positioning elements (3, 4, 5, 6) in the in-use state, wherein in each stack (26, 27) all the positioning elements (3, 5) which are arranged above a bottom positioning element (4, 6) are of the same design, and wherein the shipping box (2) is designed to accommodate the positioning elements (3, 4, 5, 6) when in the not-in-use state.

2. The shipping system according to claim 1, wherein the positioning elements (3, 4, 5, 6) are designed and can be stacked in such a way that in a stack (26, 27) at least one holding fixture (25) that is open at the top and belongs to a lower positioning element (3, 4, 5, 6) is aligned with a holding fixture (25) which is open at the bottom and belongs to an upper positioning element (3, 5) so that the holding fixtures (25) that are aligned with one another serve to secure the same article from above and from underneath.

3. The shipping system according to claim 1, wherein the holding fixtures (25) of the positioning elements (3, 4, 5, 6) are each shaped to hold sections of at least two different articles or to hold two different sections of the same articles.

4. The shipping system according to claim 1, wherein in each stack (26, 27), the bottom positioning element (4, 6) has a flat bottom side (24) and has only holding fixtures (25) that are open at the top.

5. The shipping system according to claim 1, wherein the positioning elements (3, 4, 5, 6) are designed for forming three stacks (26, 27) that are spaced a distance apart from one another, whereby in the in-use state of the shipping box (2), two stacks (26) are arranged at the side and one stack (27) is arranged centrally, the side stacks (26) are made of bottom positioning elements (4) that are identical in design and upper positioning elements (3) that are the same in design.

6. The shipping system according to claim 1, wherein the shipping box (2) has two side walls (9, 10), each having two corner posts (16, 17) which are designed so they can be rotatably pivoted about a pivot axis (29) between an upright position and a horizontal position.

7. The shipping system according to claim 1, wherein the shipping box (2) has a rear wall (8) rotationally pivotable about a pivot axis (12) between an upright position and a horizontal position.

8. The shipping system according to claim 1, wherein the shipping box (2) is approximately half as high in its not-in-use state as in its in-use state.

9. The shipping system according to claim 1, wherein the shipping box (2) is designed to be stackable in the not-in-use state or the in-use state.

10. The shipping system according to claim 1, wherein the shipping box (2) has a bottom (7) which has holding shoes (11) for a fork of a forklift on the front side of the shipping box (2) or at least on a side of the shipping box (2).

11. The shipping system according to claim 1, wherein the positioning elements (3, 4, 5, 6) are made of plastic.

12. The shipping system according to claim 1, wherein the articles are exhaust lines for motor vehicles, in particular for passenger vehicles.

13. A shipping system for shipping articles having a shipping box (2) which can be converted between an in-use state in which the shipping box (2) can be loaded with articles and a not-in-use state in which the shipping box (2) has a reduced height in comparison with the in-use state while still having the same base area, having multiple positioning elements (3, 4, 5, 6), each having at least two holding fixtures (25) arranged side-by-side, each being shaped to hold a section of one of the articles, wherein the positioning elements (3, 4, 5, 6) can be stacked one above the other, wherein the shipping box (2) is designed to accommodate at least one stack (26, 27) of positioning elements (3, 4, 5, 6) in the in-use state, wherein the shipping box (2) is designed to accommodate the positioning elements (3, 4, 5, 6) when in the not-in-use state, wherein the shipping box (2) has a guide rod (15) for each stack (26, 27) on a rear side and has a front guide rod (20) on a front side, and wherein the positioning elements (3, 4. 5) have on their ends guide holding fixtures (28) in which the guide rods (15, 20) engage when the positioning elements (3, 4, 5, 6) are stacked together.

14. A shipping system for shipping articles having a shipping box (2) which can be converted between an in-use state in which the shipping box (2) can be loaded with articles and a not-in-use state in which the shipping box (2) has a reduced height in comparison with the in-use state while still having the same base area, having multiple positioning elements (3, 4, 5, 6), each having at least two holding fixtures (25) arranged side-by-side, each being shaped to hold a section of one of the articles, wherein the positioning elements (3, 4, 5, 6) can be stacked one above the other, wherein the shipping box (2) is designed to accommodate at least one stack (26, 27) of positioning elements (3, 4, 5, 6) in the in-use state, wherein the shipping box (2) is designed to accommodate the positioning elements (3, 4, 5, 6) when in the not-in-use state, wherein the shipping box (2) has two side walls (9, 10), each having two corner posts (16, 17) which are designed so they can be rotatably pivoted about a pivot axis (29) between an upright position and a horizontal position, and wherein the corner posts (16, 17) each have an upper post section ($16_o$, $17_o$) which is adjustable in a translational movement between a retracted lower position in a lower post section ($16_u$, $17_u$).

15. The shipping system according to claim 13, wherein the front guide rods (20) in the in-use state of the shipping box (2) are each inserted into a rod holding fixture (21) provided on the bottom (7) of the shipping box (2), the shipping box (2) in the not-in-use state is designed to accommodate the front guide rods (20) removed from the rod holding fixtures (21).

* * * * *